US011305966B2

(12) United States Patent
Zhang

(10) Patent No.: US 11,305,966 B2
(45) Date of Patent: Apr. 19, 2022

(54) METHOD AND DEVICE FOR DETECTING DAMAGE IN A SUPPORT FOR AN ELEVATOR SYSTEM

(71) Applicant: Inventio AG, Hergiswil (CH)

(72) Inventor: Fan Zhang, Hergiswil (CH)

(73) Assignee: INVENTIO AG, Hergiswil NW (CH)

( * ) Notice: Subject to any disclaimer, the term of this patent is extended or adjusted under 35 U.S.C. 154(b) by 776 days.

(21) Appl. No.: 16/302,135

(22) PCT Filed: May 15, 2017

(86) PCT No.: PCT/EP2017/061605
§ 371 (c)(1),
(2) Date: Nov. 16, 2018

(87) PCT Pub. No.: WO2017/198612
PCT Pub. Date: Nov. 23, 2017

(65) Prior Publication Data

US 2020/0307956 A1 Oct. 1, 2020

(30) Foreign Application Priority Data

May 17, 2016 (EP) ..... 16169965

(51) Int. Cl.
*B66B 7/12* (2006.01)
*B66B 7/06* (2006.01)

(52) U.S. Cl.
CPC ..... *B66B 7/1223* (2013.01); *B66B 7/06* (2013.01)

(58) Field of Classification Search
CPC ..... B66B 7/1223; B66B 7/06
See application file for complete search history.

(56) References Cited

U.S. PATENT DOCUMENTS

| | | | | |
|---|---|---|---|---|
| 8,225,908 | B1 | 7/2012 | Schmutter | |
| 10,336,580 | B2 * | 7/2019 | Cereghetti | B66B 7/1223 |
| 2007/0180925 | A1 * | 8/2007 | Stucky | G01N 27/20 73/810 |

(Continued)

FOREIGN PATENT DOCUMENTS

| | | | |
|---|---|---|---|
| CN | 2272882 | Y | 1/1998 |
| CN | 1373733 | A | 10/2002 |

(Continued)

*Primary Examiner* — Jeffrey Donels
(74) *Attorney, Agent, or Firm* — William J. Clemens; Shumaker, Loop & Kendrick, LLP

(57) ABSTRACT

A method and a correspondingly configured device detect damage or defects in a support, including at least one tension member, for an elevator system. A pulse generator generates at least one electrical digital input signal that represents at least one first binary number and is fed to the tension member. After the digital input signal has passed through the tension member, it is detected as a digital output signal that likewise represents at least one second binary number. The second binary number is then compared, in particular compared digit by digit or bit by bit, with a setpoint binary number and/or directly with the first binary number. Damage in the tension member is determined on the basis of an issued comparison result. If the second binary number deviates from the setpoint binary number and/or from the first binary number, a fault message is generated.

15 Claims, 2 Drawing Sheets

(56) References Cited

U.S. PATENT DOCUMENTS

| | | | | |
|---|---|---|---|---|
| 2016/0229667 | A1* | 8/2016 | Cereghetti | B66B 7/1223 |
| 2019/0256324 | A1* | 8/2019 | Antin | B66B 7/1223 |
| 2020/0207574 | A1* | 7/2020 | Hosemann | B66B 5/0031 |

FOREIGN PATENT DOCUMENTS

| | | | |
|---|---|---|---|
| CN | 1582252 | A | 2/2005 |
| CN | 1633390 | A | 6/2005 |
| CN | 1882493 | A | 12/2006 |
| GB | 623228 | A | 5/1949 |
| WO | 2012030332 | A1 | 8/2012 |
| WO | 2014130029 | A1 | 8/2014 |

* cited by examiner

METHOD AND DEVICE FOR DETECTING DAMAGE IN A SUPPORT FOR AN ELEVATOR SYSTEM

FIELD

The present invention relates to a method as well as a device for detecting damage in a support means comprising at least one tension member for an elevator system.

BACKGROUND

Elevator systems typically have at least one elevator car, which can be moved between floors. The car is thereby generally moved along an elevator shaft with the help of a rope-like or belt-like support means. If applicable, a counterweight can be provided, which is also suspended on such a support means, so that the counterweight also moves in the opposite direction to the car.

In the course of the operation of the elevator system, the support means is bent and/or flexed again and again for example by repeated deflection on deflection rollers or the driving pulley, respectively, and is thus placed under heavy mechanical load. To be able to reliably prevent for example a tearing or breaking of the support means as a result of such mechanical loads and a plummeting of the car or of the counterweight, which may be associated therewith, damage or wear within the support means have to be detected in due time and in a reliable manner.

The support means can for example be a belt, a rope or the like. As a belt, the support means usually has a plurality of electrically conductive metal tension members and an electrically insulating jacket, which usually consists of a synthetic material or a polymer, respectively, encompasses the tension members from the outside and can protect them against corrosion or mechanical wear.

A determination or monitoring of an electrical resistance or of an electrical conductivity, respectively, of a support means or tension member, respectively, was recognized, on principle, as possibility for detecting damage in the support means.

WO 2014130029 A1 describes a method for detecting damage in a support means of an elevator system, in the case of which at least a part of the support means is subjected to an electrical AC voltage and an electrical impedance is measured in this part of the support means, on the basis of which a conclusion can be drawn to damage states in the belt or rope.

WO201230332 discloses a monitoring system for a support means, wherein the monitoring system comprises a circuit and a resistance circuit for being able to couple to the support means. The resistance circuit has a first and a second group of resistors, wherein the second group of resistors is configured to be able to supply a reference voltage. By means of a comparator, a voltage on a resistor can be compared with the reference voltage and can thus generate an output signal. The circuit monitors an effective resistance of the support means with regard to the output signal.

The two above-mentioned methods are based on an analogous data processing method and measure either an electrical current or an electrical voltage. They could thus be highly failure-prone.

SUMMARY

The invention is based on the object of being able to monitor a support means of an elevator system, which has at least one electrically conductive tension member, in a simple and safe manner.

The invention is based on the idea of detecting damage within a support means with the help of its ability to transmit signals. Such damage, which could occur for example in the form of tears or breaks in the support means, is for the most part associated with a change of the ability to transmit signals, caused by the damage, within the support means. An electrical analog signal can be converted into an electrical digital signal comprising a certain time discretization (scanning) or period duration, respectively, by means of an analog-digital converter, a so-called A/D converter. A digital signal converted in this way oscillates between two different signal levels or logic levels, respectively, a high level and a low level, with a set constant signal frequency, wherein the high or the low level, respectively, are usually represented by means of a logical function of a logical one "1" or a logical zero "0", respectively. An electrical digital signal can thus be coded as binary number, so that the quantification thereof can be specified in bits. In that it is to be monitored, how such digital signals of "0" and "1" are transmitted in the support means, damage in the support means can be determined at an early stage or a defective or inadequate tension member, respectively, can be determined.

According to the invention, a method for detecting damage or defects in a support means comprising at least one tension member for an elevator system is specified. The support means can for example be a belt, a rope or the like. The tension member consists of an electrically conductive material, such as, e.g., steel or another metal. At least one electrical digital input signal is thereby generated by means of a pulse generator. The digital input signal can represent at least one first binary number. A so-called binary number means that it is represented by one or several logical ones and/or logical zeros and thus consists exclusively of digit "1" and/or "0". The digital input signal can be assigned to the at least one tension member, so that this tension member can be analyzed by means of the digital input signal or the first binary number, respectively. The digital input signal is fed to the tension member. After the digital input signal has passed through the tension member, it is detected as a digital output signal, e.g. by means of a detector, wherein the digital output signal likewise represents at least one second binary number. The pulse generator and the detector can be clocked or operated, respectively, with an identical frequency and period duration. The second binary number is then compared, in particular compared digit by digit or bit by bit, with a binary setpoint binary number and/or directly with the first binary number. The binary setpoint binary number can be specified, e.g. as a constant value or can be generated dynamically on the basis of a current digital input signal. Damage in the tension member is determined on the basis of an issued comparison result. If the second binary number deviates from the setpoint binary number and/or from the first binary number, a fault message is generated.

The fault message can be in different forms and can be transmitted to a control device of the elevator system or to a monitoring center, respectively, and/or maintenance center, which are spaced apart from the elevator system. In contrast to methods, in the case of which a support means is to be monitored by means of a measurement of electrical resistances on the basis of analog signals, this monitoring in the case of the method introduced here is carried out digitally in a simple manner, without having to measure failure-prone factors, such as, e.g. electrical resistances or voltages.

At least one analog electrical signal is generated by means of a signal source, such as, e.g. a voltage or current source, wherein the signal source serves as a signal generator. The analog electrical signal, e.g. a current or a voltage, is converted into a digital electrical signal by means of the pulse generator. A digit "1" of the first or of the second binary number can thus represent a pulse of a physical variable such as, e.g. of an electrical voltage or an electrical current. The level and the pulse length of the pulse depend, e.g., on the length, the diameter or the material, respectively, of a tension member. The signal source can be a direct voltage or direct current source, but also an alternating voltage or alternating current source.

Advantageously, the method according to the invention can be carried out for the tension member or members of the support means individually, in part or as a whole. The tension members can be grouped into at least one group, when the support means has two or more tension members. The method can then likewise be carried out individually, in part or as a whole for the tension members of the group. In the case of two or more groups of tension members, this method can likewise be carried out separately either for an individual group or simultaneously for two or more groups.

According to a further advantageous embodiment of the invention, the at least one group can have an identical or different tension member number. In particular advantageously, the total number of the tension members of the support means corresponds to a double or multiple number of a tension member number of the group. In the case of such a support means, a belt is used. Several tension members are thereby accommodated as a core in a jacket of the belt. A belt usually comprises 12, 16, 20 or 24 tension members. It is thus advantageous, e.g., to group the tension members into one group, three, four, five or six at a time, so that each group comprises four tension members. In this case, the first binary number is a four-digit binary number for all groups or tension members, respectively.

According to a further advantageous embodiment of the invention, the generation of the digital input signal takes place in such a way that the total number of digits or the number of bits of the first binary number is identical to or larger than the tension member number of the support means or of the group. As an example for this, a first binary number, such as 0001, 000001 or 100010 can be formed, when a group only comprises four tension members.

According to a further advantageous embodiment of the invention, the first binary number has at least one first extra digit. This first extra digit is to be occupied, e.g. by a digit "1", but also possibly with a digit "0". Within a group of tension members, the first extra digits of all first binary numbers can be positioned differently to each other and in particular shifted relative to each other. By means of different first extra digits, the first binary numbers can thus represent or show different tension members in one group or in the support means. In the simplest way, the first binary number only has one first extra digit, at which either a digit "1" or "0" exists. For this case, the first binary number such as 0001, 0010, 0100 or 1000 could be formed, when one group comprises, e.g., four tension members. In addition, the sequence of the digit "1" in the first binary numbers can also correspond to the sequence of the tension members of the group. As alternative, a first binary number, the binary number of digits of which is more than the tension member number of the group or of the support means, can also have a corresponding number of first extra digits, wherein at least one of them can determine an individual tension member. In this case, the first extra digits can be occupied by digits "1" and/or "0", as needed.

According to a further advantageous embodiment of the invention, the second binary numbers can be added to each other. A sum resulting therefrom is evaluated to determine damage in a tension member or the tension members in a group, in that the sum is compared with the stored setpoint binary number and/or with the first binary number. The detection method for one group or for the support means can thus even be carried out only all at once, so that all tension members of the group or of the support means are already detected or analyzed, respectively. When each first binary number only has one first extra digit with a digit "1", whereby such extra digits are shifted relative to each other, and only digit "0" exists at all other binary positions of the first binary number, a resulting sum of all first binary numbers should have a number of digits "1", which is identical to the entire number of the analyzed tension members. This signifies a normal state of the support element.

If a digital input signal or a first binary number, respectively, was transmitted with a delay due to failures or another technical error, it could happen that the scanning or period duration of the first or of the second binary number, respectively, could be different. As a result, the binary digit position of the digit "1" in the second binary number can no longer be kept, like it is kept in the corresponding first binary number. The second binary numbers can thus not add up correctly, because the binary digits do not correspond one to one. Such a case occurs e.g. in digital electrotechnology, when a brief false statement happened in an electrical circuit or a temporary falsification of a logical function due to different signal running times. This case is then considered to be an unknown state and is identified by a special value, e.g. a third value "X" next to the digit "0" and "1".

The resulting sum is to thus be defined as a special value, when the first and/or the second binary number have a different period duration or different numbers of digits. I.e., when the sum has a different number of digits "1" or is a special value, this means a faulty state of the support means. Depending on how many and which binary digits, at which no digit "1" exists, it can be evaluated, how many and which tension member or members have damage.

According to a further advantageous embodiment of the invention, the first binary number has at least one second extra digit, which can represent or show a certain group, whereby a binary value at the second extra digit remains unchanged. The individual group can thus also be differentiated from each other, when a plurality of groups is present. The second extra digit can also be generated separately to the first binary number, i.e. the second extra digit can be represented by an independent binary number, which represents a certain group.

A device according to the invention for detecting damage or defects in a support means comprising at least one tension member for an elevator system is furthermore configured, wherein the device comprises a pulse generator for generating at least one electrical digital input signal. The electrical digital input signal can represent at least one first binary number. The input signal can be applied to a first connection of the tension member. The device has a detector for detecting an electrical digital output signal, wherein the output signal can also represent at least one second binary number. The digital output signal is in fact considered to be a digital input signal, which is transmitted from the first connection by means of the tension member to the second connection. The device also has a processor for comparing, in particular for comparing digit by digit or bit by bit, the second binary number with a setpoint binary number and/or directly with the first binary number. The processor can evaluate an issued comparison result. The device furthermore has a fault indicator for generating a fault message, when the second binary number differs from the first binary number and/or from the setpoint binary number.

According to an advantageous embodiment of the invention, the device can be connected to at least one signal source, such as, e.g. a voltage source and/or a current source, wherein the signal source can generate an analog electrical signal.

The binary setpoint binary number can advantageously be specified as a constant value or can be generated dynamically by the processor on the basis of the current digital input signal.

According to an advantageous embodiment of the invention, the pulse generator and the detector can be operated or clocked, respectively, with an identical frequency and period duration, so that a synchronization between the two units or between the signal transmitting and receiving, respectively, is created.

According to a further advantageous embodiment of the invention, the method or the device, respectively, are carried out or activated respectively, in an event-controlled manner, manually and/or automatically, when the elevator system is out of service, e.g. is in a maintenance or installation state, or in a waiting period (standby). An event can be triggered from the outside, e.g. by means of a user input or a technical value, as well as by the device itself (e.g. change notifications).

An advantageous embodiment of the invention will be described below with reference to the enclosed drawings, wherein neither the drawings nor the description are to be interpreted as limiting the invention. The drawings are only schematic and are not true to scale. Identical reference numerals identify identical features or features having identical effects.

An electrical contact point, at which the support means or the tension member thereof, respectively, can be electrically contacted for measuring, can for example be any deflection roller, wherein the deflection roller can be a deflection roller, which is arranged in a stationary manner in the elevator shaft, or also the or one of the deflection rollers of the counterweight or of the elevator car. The contact point can thus be a sliding contact or a contact point, respectively, which is for example arranged at a slight distance to the support means. This contact can be any part of the elevator system, past which the support means is guided. A so-called retainer, i.e. an anti-derailment device, which deflection rollers usually have, can also be considered as an example for this. However, support rollers of the counterweight or of the elevator car and, on principle, also the driving pulley as well as metallic shaft components can be considered as well.

The contact point can be a metallic surface, which is coated for example with a material, such as copper or brass, which has a good conductivity. Brush contacts, for example in the form of carbon fiber brushes, copper brushes or the like can be used as well. The use of brushes has an advantage that the brushes cling to a surface of the support means, i.e. that they for example exactly follow a contoured or formed surface, so that the entire surface is captured. However, what is primarily essential is that the contact point is conductive and can advantageously be grounded—in the case of operating the monitoring device with direct current—or a voltage can be applied to the contact point, respectively—in the case of operating the monitoring device with alternating current—and a contact to the conducting part or the conducting parts of a support means is possible on principle, when this conducting part of the support means comes into contact with this contact point.

This last-mentioned contact between the contact point, for example of the deflection roller, and the conducting part or the conducting parts of the support means can be created, when for example individual tension members break and subsequently pierce through the casing. This broken tension member sweeps along the contact point and thus establishes an electrical contact during the contact time. By evaluating the resulting total resistance or a corresponding current parameter, respectively, an interrupt of a tension member, a cross fault or short circuit between tension members or damage to the casing or a piercing of individual tension members, respectively, can thereby be determined.

DETAILED DESCRIPTION

Figure 1:
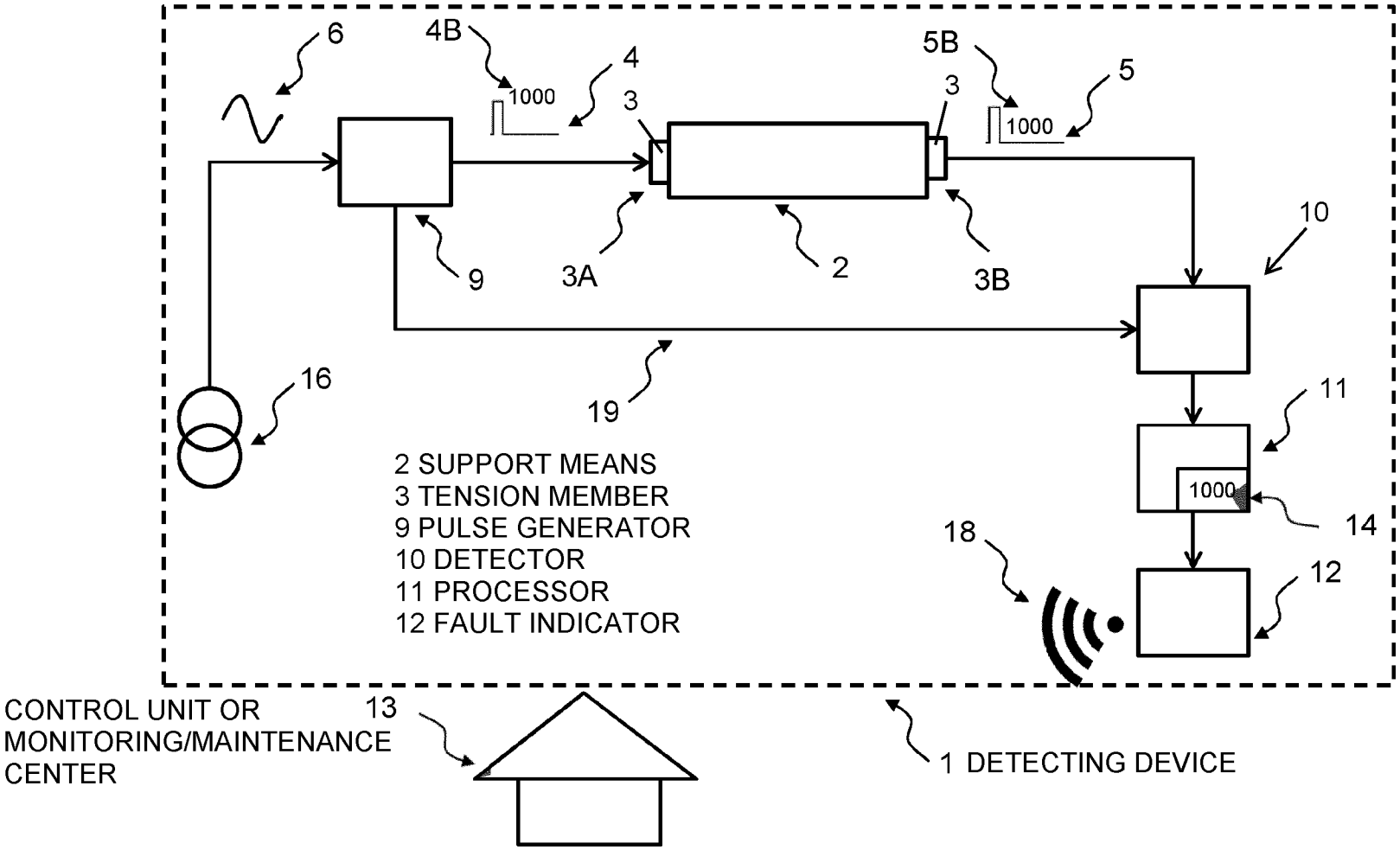
FIG. 1 shows a schematic illustration of a device according to the invention for detecting damage in a support means for an elevator system.

FIG. 1 shows a device 1 according to the invention for detecting damage in a support means 2 for an elevator system (not illustrated). The support means 2 can for example be a belt, a rope or the like. Today, belts are frequently used as modern support means for elevator systems. The support means 2 has at least one tension member (not illustrated in FIG. 1), wherein the tension member can consist of an electrically conductive material, such as, e.g., steel.

An analog electrical signal 6 is generated by means of a signal source, such as, e.g., a direct voltage or direct current source 16. A pulse generator 9 subsequently provides for a conversion of analog signals into digital signals. The analog electrical signal 6, e.g. a matching current or an adequate voltage, is hereby converted into a digital electrical input signal 4 or in the form of a first binary number 4B, respectively.

In a simplest way, the pulse generator 9 can be an A/D converter or can generate a settable basic clock for pulse sequences, respectively, i.e. settable pulse group subsequent periods. The pulse generator 9 may be configured as a pulse width modulator (PWM), so that the input signal 4 can also be generated in the form of pulse sequence and the pulse amplitude or signal level or the pulse width, respectively, can be flexibly adjusted as needed. One advantage for this is that the bit time for a logical one "1" and a logical zero "0" can be placed differently as needed.

The pulse sequence generated by the pulse generator 9, thus the digital input signal 4, can be fed flexibly on an individual support member 3 of the support means 2 either separately or on several or all of the tension members 3 of the support means 2, in part or simultaneously to all with the help of a software or an electronic circuit technology, such as, e.g. a multiplexer, TTL (transistor-transistor-logic) or CMOS (complementary metal-oxide-semiconductor), respectively. Such a multiplexer can also be made so as to be integrated into the pulse generator 9.

The digital input signal 4 can be assigned to a tension member 31 (FIG. 2) and can be applied to the first connection 3A thereof. The digital input signal 4 or the first binary number 4B, respectively, is thereby fed to the tension member 31 and is transferred by means of this tension member 31 to the second connection 3B thereof. The second connection 3B is located at the opposite end of the tension member 3 opposite to the first connection 3A. The connections 3A and 3B thereby serve as an interface, which is able to transmit the binary numbers fed to the support means 2 either individually or together or in combination.

A digital output signal 5 can be detected by a detector 10 on the second connection 3B, wherein the output signal 5 is likewise represented by means of at least one second binary number 5B. The digital output signal is in fact considered to be a first input signal, which is transmitted from the first connection by means of the tension member to the second connection. The device 1 further has a processor 11, which can receive digital signals from the detector 10, and a fault indicator 12 for generating a fault message. The signal processor 11 can receive and analyze the output signals 5 continuously or at regular time intervals from the detector 10. A synchronization 19 exists between the detector 10 and the pulse generator 9, so that the two units can work at the same clock rate in response to signal processing. The clock is determined by the frequency or the period duration of the generated input signal 4.

The second binary number 5B detected by the detector 10 can either be compared with a binary setpoint binary number 14 or directly bit by bit with the corresponding first binary number 4B by means of the processor 11. The binary setpoint binary number 14 can be stored beforehand as a reference value or can be generated dynamically by the processor 11 on the basis of the current first binary number 4B. A comparison result resulting therefrom is analyzed or evaluated, respectively, in the processor 11. When the second binary number 5B is not identical to the first binary number 4B and/or to the setpoint binary number 14, a fault message is generated. The fault message can be generated in different forms, such as, e.g. acoustically or optically. The fault message will be transmitted to a control device of the elevator system or to a monitoring center and/or maintenance center 13, respectively, located at a distance from the elevator system, in order to point out a risk of damage present in the tension member 31 or in the support means 2, respectively.

Even though it is shown in FIG. 1 that the device 1 and the signal source 16 are located within the elevator system, it is not ruled out, however, that this device 1 or the signal source 16, respectively, are arranged outside or at least partially outside of the elevator system.

Figure 2:
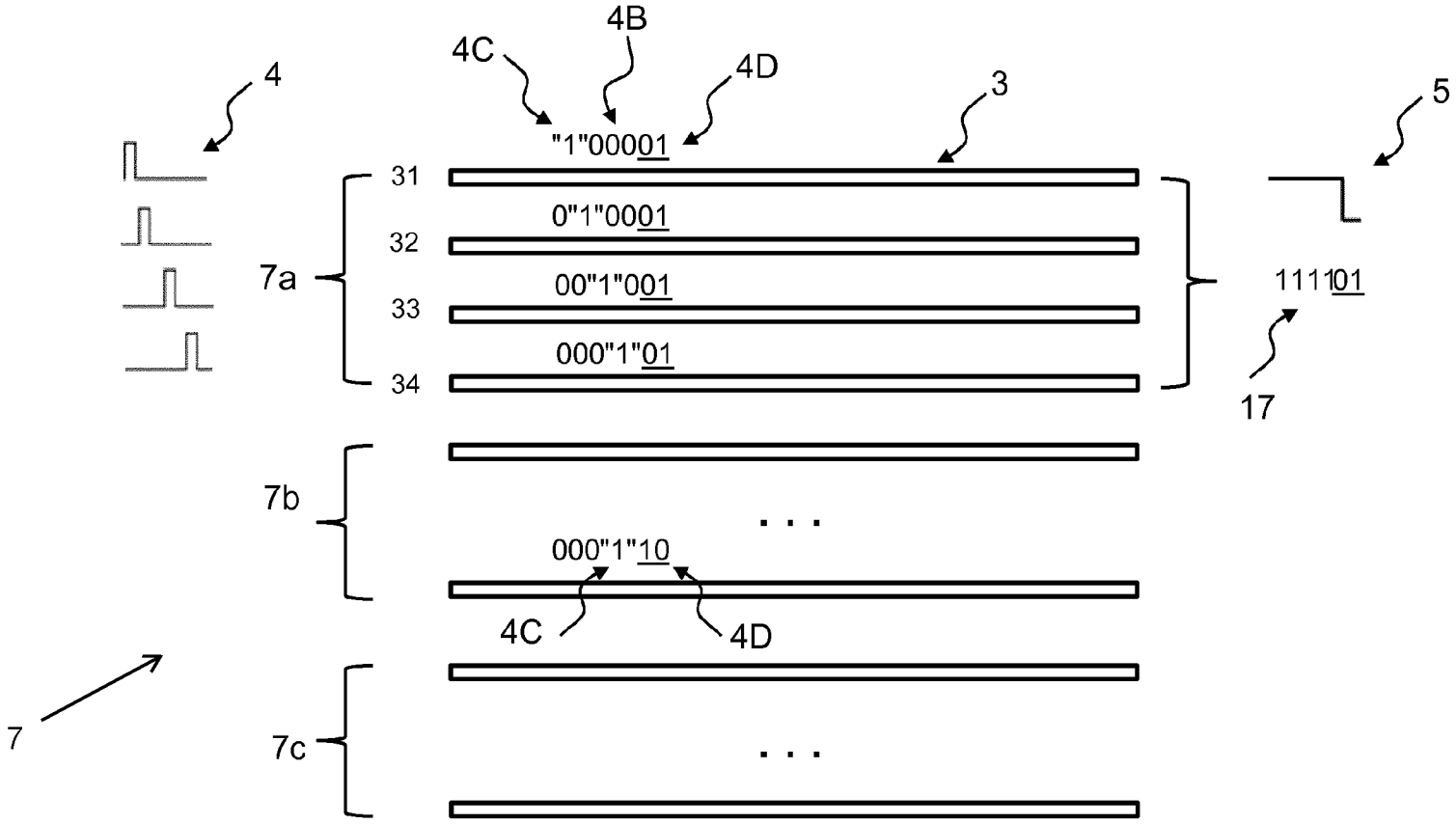
FIG. 2 shows an exemplary embodiment for a determination of damage in an individual tension member of the support means.

FIG. 2 shows an exemplary embodiment for a determination of damage in an individual tension member 3 of the support means 2. A detection method can be carried out either separately for one tension member 3 or simultaneously for several tension members 3. In this exemplary embodiment, the support means 2 is provided with a total of twelve tension members 3. The twelve tension members 3 are thus distributed into three groups 7*a*, 7*b*, 7*c*, so as to be able to more quickly determine or detect damage in the support means 2. The respective groups 7*a*, 7*b*, 7*c* comprise four tension members, wherein the first group 7*a* has the tension members 31, 32, 33 and 34. That is, the number of all of the tension members 3 of the support means 2 is a triple number of the number of the tension members 3 in a group 7*a*, 7*b*, 7*c*. For a belt 2 with 16, 20 or 24 tension members 3, the tension members 3 can be divided, e.g. analogously to the above-described design, into four, five or six groups 7, wherein each group 7 comprises four tension members 3. For a simplified overview, only the first and the last tension member in the groups 7*b* and 7*c* are illustrated here.

The detection method is carried out at the same time, e.g. for the tension members 31, 32, 33, 34 in the first group 7*a*. By means of the pulse generator 9, an electrical analog signal 6, which is generated by the signal source 16, can be converted into an electrical digital input signal 4 and then be generated in the form of a first binary number 4B with an identical period duration in such a way that the number of digits or the number of bits of the first binary number 4B is identical to the tension member number of the first group 7*a*, 7*b*, 7*c*. The generated first binary numbers 4B are then four-digit binary numbers. One of the first binary numbers 4B is assigned to each tension member 31, 32, 33, 34, whereby the tension members 31, 32, 33, 34 are analyzed by means of the digital input signal 4 or the first binary number 4B, respectively.

The first binary number 4B has a first extra digit 4C, which is marked with a leader character " ". Within the group 7*a*, such first extra digits 4C are positioned differently to each other and are in particular shifted relative to each other. For this exemplary embodiment, each first binary number 4B has a pulse, namely a digit "1" at the extra digit 4C thereof, wherein the binary digit position of the digit "1" in the first binary number 4B represents a certain tension member 31, 32, 33, 34. In addition, the positions of the digit "1" are a sequence, which corresponds to a sequence of the tension members 31, 32, 33, 34 in the group 7*a*. The binary numbers 4B for the group 7*a* could thus be generated, e.g., in a sequence of "1000", "0100", "0010", and "0001", wherein the positions of the digit "1" signifies the four tension members 31, 32, 33, 34 of this group 7*a* from top to bottom.

The four first binary number 4B, "1000", "0100", "0010", and "0001" are fed to the respective assigned tension member 31, 32, 33, 34. An electrical digital output signal 5, which is likewise represented by a second binary number 5B, is detected at a second connection 3B of the tension member 3. The total of four second binary numbers 5B are added up, resulting in a binary number as the sum 17. This sum 17 is compared digit by digit with a binary setpoint binary number 14 or directly with the first binary numbers 4B by means of a processor 11, wherein the setpoint binary number 14 is specified as constant value or is generated dynamically by means of the processor 11 on the basis of a current digital input signal 4.

Damage in the tension members 31, 32, 33, 34 can be determined on the basis of a comparison result. In the case of a good state of the support means 2, the first binary numbers "1000", "0100", "0010", and "0001" are transmitted by the tension members 31, 32, 33, 34 without losses or interfering noise, respectively. I.e., the same binary numbers as the first binary numbers "1000", "0100", "0010", and "0001" are to be detected at the second connection 3B. The four binary numbers are added up. A binary number of "1111" results as a sum 17. A binary number "1111" is hereby already specified as the setpoint binary number 14. It is thus known that all four tension members 31, 32, 33, 34 have no damage, when the sum 17 corresponds with the setpoint binary number 14. If damage or a wear is present in the tension members 31, 32, 33, 34, the second binary number 5B will have a binary number other than "1111".

The sum 17 can also be compared with the respective first binary numbers 4B. Damage in the tension members 31, 32, 33, 34 can be determined on the basis of an issued comparison result, if the second binary numbers 5B differ from the corresponding first binary numbers 4B. It can furthermore be determined immediately, how many and which tension member or members have damage. When, e.g. a second binary number "1011" is detected, this means that the second tension member 32 has damage. Analogously, "0111" applies for the tension member 31, "1101" for the tension member 33, and "1110" for the tension member 34.

If a first binary number 4B was transmitted with a delay, the period durations or the number of digits, respectively, of the first 4B or of the second binary numbers 5B, respectively, then no longer remain identical. The second binary numbers 5B can thus not add up correctly, because the binary digit positions of the digit "1" in the second binary numbers 5B are not shifted exactly digit by digit. A third value "X" is placed next to the digit "0" and "1" in this case, which suggests an unknown state. The sum 17 is then set as a third value "X".

When damage or an unknown state was detected in one of the tension members 31, 32, 33, 34, a fault message is generated by a fault indicator 12. This fault message can be transmitted to a monitoring center and/or maintenance center 13.

This transmission can take place, e.g. by means of a public or private network 18, such as Internet or LAN (local area network) and by means of wired or wireless transmissions. The connection of the device 1 or of the elevator system, respectively, to the center 13 can thereby take place via mobile communications, DSL (digital subscriber line) or existing private network infrastructures.

Furthermore, the first binary number 4B can additionally have a second extra digit 4D, which can represent or show a certain group 7, wherein a binary value at the second extra digit remains unchanged. The second extra digit 4D can also be generated separately from the first binary number 4B by the pulse generator 9, i.e. the first binary number 4B and the second extra digit 4D can either be represented together by a binary number or separately by two binary numbers. A binary number of the individual group 7*a*, 7*b*, 7*c* can thus also be differentiated from each other. One example for this would be that the binary numbers 100001, 010001 represent the first 31 and the second tension member 32 of the first group 7*a*, the binary numbers 010010, 001010 represent the second 32 and the third tension member 33 of the second group 7*b*, and the binary numbers 001011, 000111 represent the third 33 and the fourth tension member 34 of the third group 7*c*, wherein the last two binary digits, which are marked with underlining, are the second extra digits 4D.

Such a detection nor determination method, respectively, for the three groups 7*a*, 7*b*, 7*c* can arbitrarily be carried out separately for one group or simultaneously for two or for all three groups 7*a*, 7*b*, 7*c*. Several or all tension members 3 of the support means 2 can thus be analyzed or monitored simultaneously, in that the device 1 only has to be analyzed a few times or even only once.

In the alternative, the above-specified explanations can be illustrated by means of the Tables below. One example for a test for the tension member groups 7*a* is illustrated in Table-1, when all tension members 31, 32, 33, 34 are in a good state.

TABLE 1 tension members in a good state

| tension member | input signal | | sum | evaluate |
|---|---|---|---|---|
| 31 | 100001 | | | |
| 32 | 010001 | | | |
| 33 | 001001 | ⟹ | 111101 | OK |
| 34 | 000101 | | | |

One example for a test for the tension member group 7*a* is illustrated in Table-2, if there is damage, such as, e.g. a break or penetration exist in the case of at least one tension member 31, 32, 33, 34.

Table-2: error in one or several tension members

TABLE 2 error in one or several tension members

| tension member | input signal | | sum | evaluate |
|---|---|---|---|---|
| 31 | 100001 | | 011101 | error in 31 |
| 32 | 010001 | ⟹ | 101101 | error in 32 |
| 33 | 001001 | | 110101 | error in 33 |
| 34 | 000101 | | 111001 | error in 34 |
| | | | 101001 | error in 32 and 34 |
| | | | 001001 | error in 31, 32 and 34 |

A further example for a test of the tension member group 7*a* is illustrated in Table-3, when there is damage in the tension member 32. Different errors can occur thereby. In the case of a short circuit, an "X" could result on the second connection 3B of the tension member 32, in the case of a penetration or a resistance, which is too high, a second binary number "000001" could result, in the case of a resistance, which is too low, a second binary number "111101" could result, and in the case of a faulty transmission, such as, e.g. a delay, "001001" could result. Depending on what kind of error occurs, an error can either be determined for the concrete tension member 32 or for the group 7*a* or for the support means 2.

TABLE 3 error in the tension member 32

| tension member | input signal | output signal | | sum | evaluate |
|---|---|---|---|---|---|
| 31 | 100001 | 100001 | | | |
| 32 | 010001 | 000001 | ⟹ | 101101 | error in 32 |
| | | 001001 | | X01 | error in group 7a |
| | | 111101 | | X | error in the support means |
| | | X | | | |
| 33 | 001001 | 001001 | | | |
| 34 | 000101 | 000101 | | | |

The above-illustrated method or the device 1, respectively, can be carried out or activated, respectively, separately for an individual tension member 3 of the support means 2 or in part or simultaneously to all for the entire tension member 3 of the support means 2, both manually and automatically, when the elevator system is out of service, e.g., is in a maintenance or installation state, or in a waiting period (standby).

In summary, embodiments of the method introduced herein or of the device 1 introduced herein, respectively, allow the detection of damage within the support means 2 or the tension members 3, respectively, using a digital electronics in a reliable manner. Slight damage within the support means 2 can already be detected by means of a fine setting of the pulse generator 9, such as, e.g. the period duration, scanning or level, so that the output signal 5 or the second binary number 5B, respectively, can still be detected plausibly as a result of the associated changes of the ability to transmit signals in the damaged tension member 3.

Lastly, it is important to point out that terms, such as "having", "comprising", etc. do not exclude other elements or steps, and a term, such as "one" do not absolutely exclude a plurality. It is further important to point out that features or steps, which have been described with reference to one of the above exemplary embodiments, can also be used in combination with other features or steps of other above-described exemplary embodiments.

It is pointed out that possible features and advantages of exemplary embodiments of the invention are described herein in part with reference to a method according to the invention and in part with reference to a device according to the invention. A person of skill in the art will recognize that the individual features can be combined in a suitable manner, can be modified or exchanged and that features, which are in particular described for the method, can analogously be transferred to the device, and vice versa, in order to get to further embodiments of the invention.

In accordance with the provisions of the patent statutes, the present invention has been described in what is considered to represent its preferred embodiment. However, it should be noted that the invention can be practiced otherwise than as specifically illustrated and described without departing from its spirit or scope.

LIST OF REFERENCE NUMERALS

1 device for an elevator system
2 support means
3 tension member
31, 32, 33, 34 grouped tension members
3A the first connection of the tension member
3B the second connection of the tension member
4 digital input signal
4B the first binary number
4C the first extra digit
4D the second extra digit
5 digital output signal
5B the second binary number
6 analog signal
7 group of the tension members
7*a*, 7*b*, 7*c* three groups of the tension members
9 pulse generator
10 detector
11 processor
12 fault indicator
13 control unit or monitoring center/maintenance center
14 setpoint binary number
16 signal source
17 sum
18 network
19 synchronization

The invention claimed is:

1. A method for detecting damage in an elevator system support means having at least one tension member, the method comprising the steps of:

generating a digital input signal from a pulse generator, wherein the digital input signal represents a first binary number;

feeding the digital input signal to the at least one tension member of the support means;

detecting a digital output signal after the digital input signal has passed through the at least one tension member, wherein the digital output signal represents a second binary number;

comparing the second binary number with at least one of a setpoint binary number and the first binary number;

reporting a fault state of the support means when the second binary number differs from the setpoint binary number or the first binary number; and wherein the setpoint binary number has a predetermined constant value or is generated dynamically based upon a current value of the digital input signal.

2. A method for detecting damage in an elevator system support means having at least one tension member, the method comprising the steps of:

generating a digital input signal from a pulse generator, wherein the digital input signal represents a first binary number;

feeding the digital input signal to the at least one tension member of the support means;

detecting a digital output signal after the digital input signal has passed through the at least one tension member, wherein the digital output signal represents a second binary number;

comparing the second binary number with at least one of a setpoint binary number and the first binary number;

reporting a fault state of the support means when the second binary number differs from the setpoint binary number or the first binary number; and wherein the support means has a plurality of tension members including the at least one tension member, wherein the tension members are grouped into at least one group, and wherein when the tension members are grouped into at least two groups, the at least one group includes an identical number or a different number of the tension members as another of the groups.

3. The method according to claim 2 wherein the steps are performed individually for each of the tension members, or are performed simultaneously for all of the tension members in each of the groups individually, or are performed simultaneously for all of the tension members in all of the groups, and wherein the first binary number is different for at least two of the tension members.

4. The method according to claim 3 including generating the digital input signal with a number of digits of the first binary number being identical to or larger than a number of the tension members of the support means or a number of the tension members in a group of the tension members.

5. The method according to claim 4 wherein the first binary number has a first extra digit, and wherein a position of the first extra digit in the first binary number represents an associated one of the tension members of the support means or an associated one of the tension members in the group of the tension members.

6. The method according to claim 5 wherein the positions of the first extra digits of the first binary numbers within the group or within the support means are different from each other.

7. The method according to claim 6 wherein the positions of the first extra digits of the first binary numbers are shifted relative to each other and correspond to a sequence of the tension members in the group or a sequence of the tension members in the support means.

8. The method according to claim 2 including adding the second binary numbers associated with at least two of the tension members to obtain a resulting sum, evaluating the resulting to determine damage in the at least two tension members by comparing the resulting sum with at least one of the setpoint binary number and the first binary numbers associated with the at least two tension members.

9. The method according to claim 8 including defining the resulting sum as a special value when at least two of the first binary numbers and the second binary numbers have a different period duration or different numbers of digits.

10. The method according to claim 2 wherein the first binary number has at least one second extra digit that represents a predetermined group of the tension members, and wherein a binary value of the second extra digit is the same for all of the tension members in the predetermined group.

11. A method for detecting damage in an elevator system support means having at least one tension member, the method comprising the steps of:

generating a digital input signal from a pulse generator, wherein the digital input signal represents a first binary number;

feeding the digital input signal to the at least one tension member of the support means;

detecting a digital output signal after the digital input signal has passed through the at least one tension member, wherein the digital output signal represents a second binary number;

comparing the second binary number with at least one of a setpoint binary number and the first binary number;

reporting a fault state of the support means when the second binary number differs from the setpoint binary number or the first binary number; and performing the steps in an event-controlled manner, by at least one of manually and automatically, when an elevator system that includes the support means is out of service, in a maintenance or installation state, or in a waiting period.

12. A device for detecting damage in an elevator system support means including at least one tension member, the device comprising:

a pulse generator for generating a digital input signal representing a first binary number and applying the digital input signal to a first connection of the at least one tension member;

a detector for detecting a digital output signal at a second connection of the at least one tension member, wherein the output signal represents a second binary number;

a processor for comparing the second binary number with at least one of a setpoint binary number and the first binary number;

a fault indicator for generating a fault message when the second binary number differs from the setpoint binary number or the first binary number; and wherein the pulse generator is connected with a signal source that generates an electrical analog signal to the pulse generator.

13. The device according to claim 12 wherein the setpoint binary number has a specified constant value or is generated dynamically based upon a current value of the digital input signal by the processor.

14. The device according to claim 12 wherein the pulse generator and the detector operate with an identical frequency and period duration.

15. The device according to claim 12 being activated in an event-controlled manner, by at least one of manually and automatically, when an elevator system including the support means is out of service, in a maintenance or installation state, or in a waiting period.

* * * * *